US007481696B2

(12) United States Patent
Mukai et al.

(10) Patent No.: US 7,481,696 B2
(45) Date of Patent: Jan. 27, 2009

(54) GRINDING MACHINE AND COOLANT SUPPLYING METHOD THEREFOR

(75) Inventors: Ryohei Mukai, Nagoya (JP); Nobumitsu Hori, Ichinomiya (JP)

(73) Assignee: JTEKT Corporation, Osaka-shi (JP)

( * ) Notice: Subject to any disclaimer, the term of this patent is extended or adjusted under 35 U.S.C. 154(b) by 276 days.

(21) Appl. No.: 10/592,151

(22) PCT Filed: Feb. 17, 2005

(86) PCT No.: PCT/JP2005/002949

§ 371 (c)(1),
(2), (4) Date: Sep. 8, 2006

(87) PCT Pub. No.: WO2005/105374

PCT Pub. Date: Nov. 10, 2005

(65) Prior Publication Data

US 2008/0096473 A1 Apr. 24, 2008

(30) Foreign Application Priority Data

Apr. 28, 2004 (JP) ..... 2004-133920

(51) Int. Cl.
*B24B 55/02* (2006.01)

(52) U.S. Cl. ..... 451/7; 451/58; 451/53; 451/450

(58) Field of Classification Search ..... 451/7, 451/57, 58, 53, 488, 449, 450; 125/11.22
See application file for complete search history.

(56) References Cited

U.S. PATENT DOCUMENTS

| | | | | |
|---|---|---|---|---|
| 5,833,523 | A * | 11/1998 | Hykes | 451/450 |
| 6,921,321 | B2 * | 7/2005 | Morita | 451/60 |
| 6,932,673 | B2 * | 8/2005 | Morita et al. | 451/7 |
| 2004/0005844 | A1 * | 1/2004 | Morita et al. | 451/53 |

FOREIGN PATENT DOCUMENTS

| | | |
|---|---|---|
| EP | 1 375 067 | 1/2004 |

* cited by examiner

*Primary Examiner*—Robert Rose
(74) *Attorney, Agent, or Firm*—Oblon, Spivak, McClelland, Maier & Neustadt, P.C.

(57) ABSTRACT

In a rough grinding step the large quantity of coolant supplied to cool the grinding point enables the flow to pass through a wheel-following air layer and reach the grinding point while the supply of an air jet is stopped during this step. At a fine grinding step, the grinding point can be cooled with a small quantity of coolant in so far it is reliably supplied to the grinding point. This is realized by supplying an air jet to intercept the wheel-following air layer which rotates to follow the grinding wheel, while supplying the coolant in small quantity. Consequently, the coolant is prevented from being scattered by the air jet and suspended in form of mist when supplied in large quantity at the rough grinding step, and the coolant quantity used can be reduced at fine grinding step and minute grinding step.

4 Claims, 6 Drawing Sheets

GRINDING MACHINE AND COOLANT SUPPLYING METHOD THEREFOR

TECHNOLOGICAL FIELD

The present invention relates to a grinding machine and a coolant supplying method therefor.

BACKGROUND ART

Heretofore, where a workpiece is ground with a grinding wheel, it has been a practice that coolant for cooling and lubrication is supplied to a grinding point between the workpiece and the grinding wheel to prevent grinding burn, heat stress or the like from being generated on the workpiece by the cause of grinding heat.

Recently, a coolant supply method as described in Japanese unexamined, published patent application No. 2004-17265 has been developed for performing sufficient cooling and lubrication of a workpiece and a grinding wheel in a small quantity of coolant. In the coolant supply method described in the patent document, as shown in FIG. 6 of the patent document, at the same time as the supplying of coolant is started, an air jet is blown at a position behind or upstream of a grinding point in a grinding wheel rotational direction to traverse the grinding surface of the grinding wheel from one lateral side to the other lateral side. Thus, a wheel-following air layer which rotates to follow the grinding wheel is intercepted, so that a small quantity of coolant is well adhered to the grinding surface of the grinding wheel to be delivered reliably to the grinding point.

In grinding operation, a workpiece is ground by giving a grinding wheel a rough grinding feed and a finish grinding feed which are different in feed rate and is further ground in a spark-out state by temporarily discontinuing the grinding feed of the grinding wheel at the grinding feed end. During the grinding operation, heat generation increases with an increase in the infeed amount, and coolant of the flow quantity depending on the heat generation becomes necessary in order to cool down the heat generated by the grinding. For this reason, it is necessary to supply a large quantity of coolant during the rough grinding feed which is large in infeed depth and which thus causes heat to be generated to a high temperature.

By the way, in the coolant supply method described in the patent document, the supply of the air jet is started at the same time as the supply of the coolant is started, and the supply of the air jet is stopped at the same time as the supply of coolant is stopped. That is, the air jet is supplied throughout the grinding operation from start to end.

However, a large quantity of coolant is needed for cooling during the rough grinding operation, and when the air jet is supplied toward the grinding surface with the large quantity of coolant being supplied, it results that the large quantity of coolant is scattered to be suspended in the form of mist-within a cover device of the grinding machine. Thus, it is likely that the large quantity of coolant in the form of mist continues to be suspended within the cover device even after the completion of the grinding operation and flows out when the cove device is opened and closed for unloading and loading of workpieces, thereby to deteriorate the environment within the factory having the grinding machine installed. Further, where the inside pressure within the cover device of the grinding machine is heightened by the supply of the air jet, it is likely that the suspension of the large quantity of coolant causes a part of coolant to enter the inside of the grinding machine which ordinarily does not allow coolant to enter. This gives rise to a problem that the maintenance of the grinding machine has to be done at a high frequency.

The inventors of the present application carried out repetitive experiments for preventing the large quantity of mist-like coolant from being generated during the rough grinding feed and as a result, have found out that where supplied in a large quantity, coolant supplied reaches the grinding point by passing through a wheel-following air layer which rotates to follow the grinding wheel.

DISCLOSURE OF THE INVENTION

It is an object of the present invention to prevent a large quantity of mist-like coolant from being generated by an air jet, which is supplied for intercepting a wheel-following air layer rotating to follow a grinding wheel, where a large quantity of coolant is supplied.

In order to accomplish the foregoing object, in a first aspect of the present invention, there is provided a coolant supply method in a grinding machine wherein a grinding wheel carried on a wheel head and rotationally driven is given a grinding feed relative to a workpiece supported on a workpiece support device for grinding the workpiece with a grinding surface of the grinding wheel with coolant being supplied to a grinding point. The method comprises a step of providing at a position upstream of the grinding point in a grinding wheel rotational direction a fluid jet nozzle which blows a fluid jet to traverse the grinding surface of the grinding wheel from one lateral side of the grinding wheel to the other lateral side for intercepting a wheel-following air layer rotating to follow the grinding wheel. The method further comprises a step of supplying a large quantity of the coolant while stopping the supply of the fluid jet during a heavy grinding having a large infeed per abrasive grain of the grinding wheel and a step of supplying a small quantity of the coolant while supplying the fluid jet during a light grinding having a small infeed per abrasive grain of the grinding wheel.

According to the first aspect of the present invention, during the heavy grinding having the large infeed amount per abrasive grain, the grinding point has a large quantity of heat generated thereat to rise to a high temperature, and the large quantity of coolant is supplied to cool the grinding point. By being supplied in the large quantity, the coolant is enabled to pass through a wheel-following air layer and to reach the grinding point without using the fluid jet to intercept the wheel-following air layer which rotates to follow the grinding wheel. For this reason, the supply of an air jet is stopped during the heavy grinding. Thus, the large quantity of the coolant can be prevented from being scattered by the air jet to be suspended in the form of mist during the heavy grinding. Further, at a light grinding having the small infeed amount per abrasive grain, the heat generated at the grinding point is small, and the grinding point can be cooled with the small quantity of the coolant so far as the same is reliably supplied to the grinding point. Thus, at the light grinding, it is realized to make the coolant of the small quantity reach the grinding point reliably by supplying the air jet to intercept the wheel-following air layer which rotates to follow the grinding wheel, while supplying the coolant of the small quantity. As a consequence, it can be realized to reduce the quantity of the coolant used during the light grinding. In the present invention, the term "heavy grinding" is defined as a grinding which is given such a large infeed amount that the heat generated by the grinding cannot be cooled unless the coolant is supplied in such a quantity or more that enables the coolant to pass through the wheel-following air layer, whereas the term "light grinding" is defined as a grinding which is given such a small infeed amount that the heat generated by the grinding can be cooled with the coolant which is supplied less than such a quantity that enables the coolant to pass through the wheel-following air layer.

In order to accomplish the foregoing object, in a second aspect of the present invention, there is provided a grinding machine wherein a grinding wheel carried on a wheel head and rotationally driven is given a grinding feed relative to a workpiece supported on a workpiece support device for grinding the workpiece with a grinding surface of the grinding wheel with coolant being supplied to a grinding point. The improvement in the grinding machine comprises a fluid jet nozzle provided at a position upstream of the grinding point in a grinding wheel rotational direction for blowing a fluid jet to traverse the grinding surface of the grinding wheel from one lateral side of the grinding wheel to the other lateral side so that a wheel-following air layer rotating to follow the grinding wheel is intercepted. The improvement further comprises heavy grinding control means for supplying a large quantity of the coolant while stopping the supply of the fluid jet during a heavy grinding having a large infeed per abrasive grain of the grinding wheel and light grinding control means for supplying a small quantity of the coolant while supplying the fluid jet during a light grinding having a small infeed per abrasive grain of the grinding wheel.

According to the second aspect of the present invention, the supply flow quantity of the coolant and the supply or non-supply of the fluid jet are controlled in dependence on the infeed amount at each of the grindings, and the quantity of the coolant which is scattered in the form of mist can be reduced to a small quantity, so that the environment in the factory with the grinding machine installed can be prevented from being deteriorated. Further, since the coolant is scattered in a small quantity only, it does not take place that the coolant enters the inside of the grinding machine which ordinarily dose not allow the coolant to enter, so that the grinding machine can be simplified in maintenance. In addition, since the fluid jet is supplied only when required, the quantity of the fluid jet used can be reduced, and the grinding machine can be low in the running cost.

PREFERRED EMBODIMENT TO PRACTICE THE INVENTION

Figure 1:
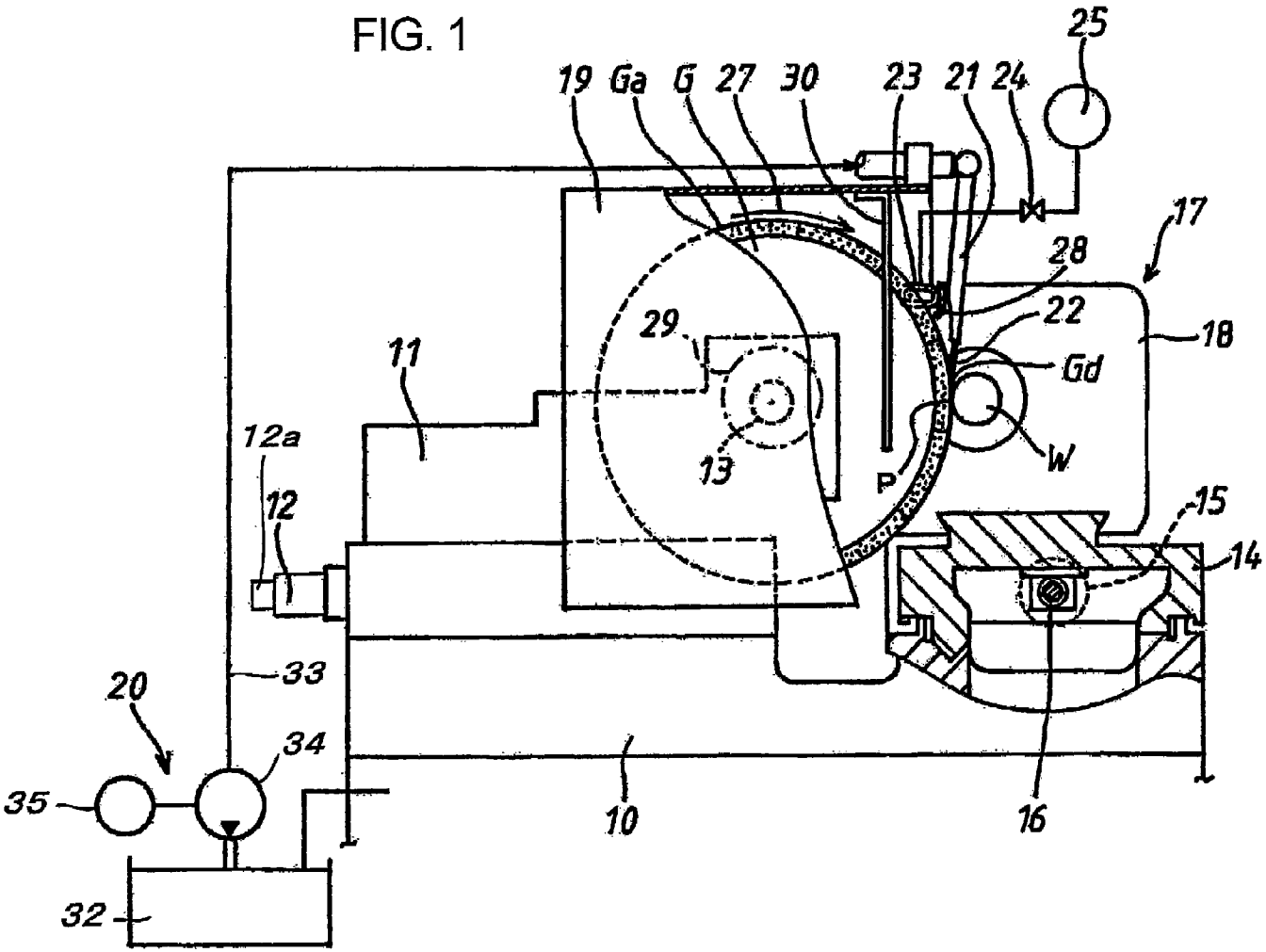
FIG. 1 is a side elevational view partly in section of a grinding machine according to the present invention.
Figure 2:
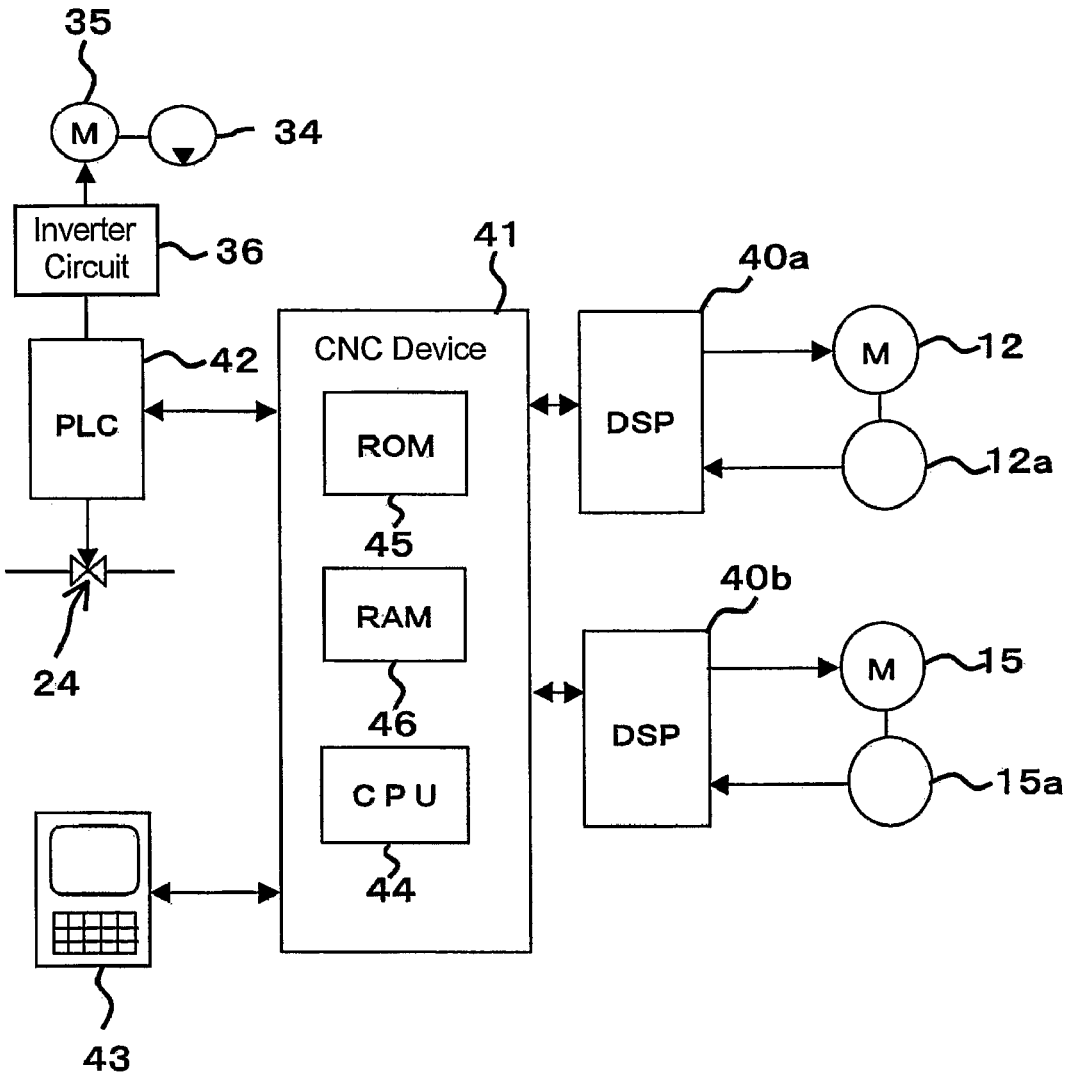
FIG. 2 is a block diagram showing a CNC device.
Figure 3:
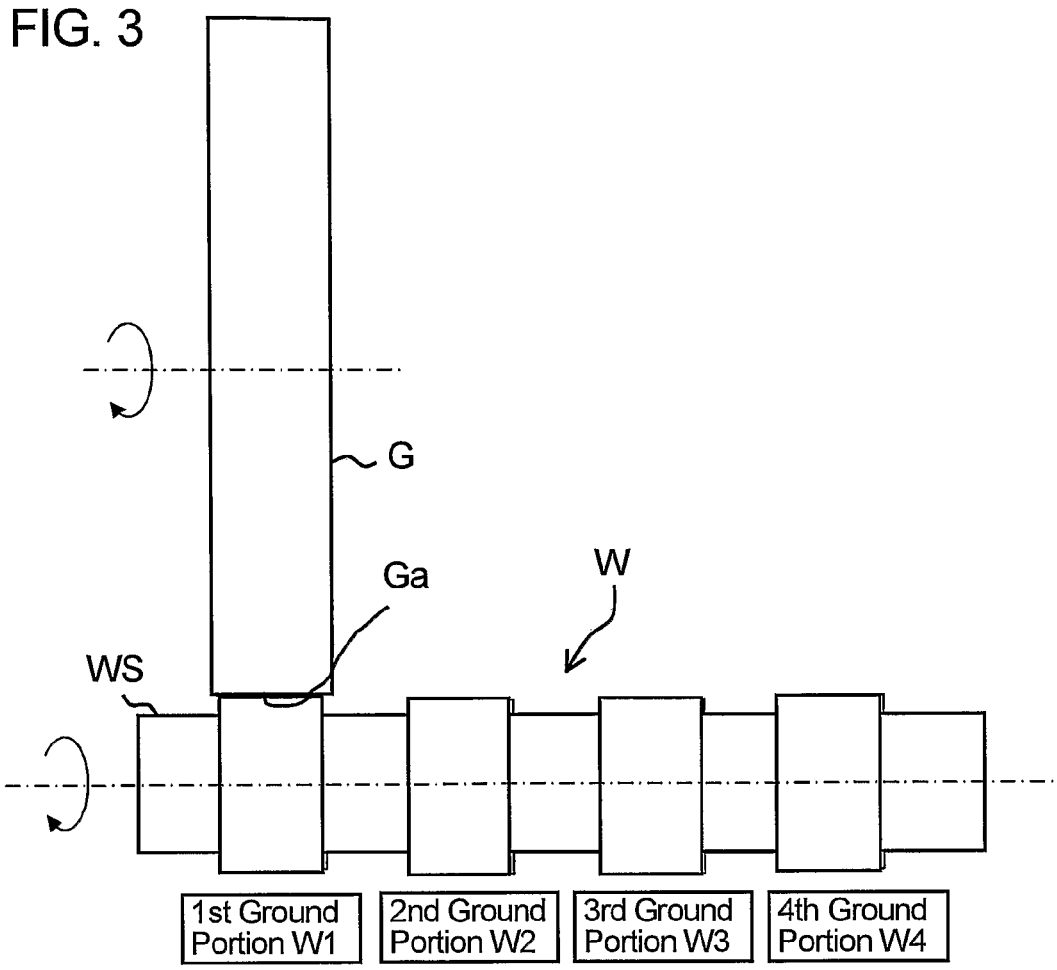
FIG. 3 is a plan view showing one example of a workpiece.

Hereafter, a grinding machine in one embodiment according to the present invention will be described with reference to FIG. 1 through FIG. 7. Referring now to FIG. 1, a wheel head 11 is slidably mounted on a bed 10 and is advanced and retracted by a servomotor 12 through a ball screw mechanism (not sown) toward and away from a workpiece W in an X-axis direction. The rotational amount of the servomotor 12 is detected by an encoder 12*a* secured to the rear end of the servomotor 12. A wheel spindle 13 with a grinding wheel G attached to one end thereof is rotatably carried on the wheel head 11 and is rotationally driven by an electric motor 29. The grinding wheel G is constructed by bonding plural grinding segments on the circumferential surface of a disc-like base member formed of a metal such as iron, aluminum or the like. A table 14 is slidably mounted on the bed 10 and is moved by a servomotor 15 through a ball screw mechanism 16 in a Z-axis direction extending perpendicular to the X-axis direction. The rotational amount of the servomotor 15 is detected by an encoder 15*a* secured to the servomotor 15, as shown in FIG. 2. Mounted on the table 14 are a work head (not shown) and a foot stock 18 which constitute a workpiece support device 17, and the workpiece W is supported to be pinched between a pair of centers of the work head and the foot stock 18. As shown in FIG. 3, the workpiece W is composed of a cylindrical, bar-shape shaft portion Ws and first to fourth ground portions W1-W4 which are formed on the shaft portion Ws at regular intervals in the axial direction of the workpiece W.

A wheel guard 19 for covering the grinding wheel G is fixed to the wheel head 11. A coolant nozzle 21 is attached on the top surface of the wheel guard 19, and coolant is supplied from the coolant nozzle 21 toward a grinding point P at which the grinding wheel G grinds the workpiece W. A coolant flow 22 reaches a grinding surface Ga at a reaching point Gd which is adjacent to the grinding point P. The coolant nozzle 21 is connected by a coolant supply conduit 33 to a coolant reservoir 32 containing the coolant, and a pump 34 of a coolant supply device 20 is provided to charge coolant into the coolant supply conduit 33. The pump 34 is rotated by a motor 35 and draws the coolant from the coolant reservoir 32 to supply the coolant nozzle 21 with the coolant flow 22.

Figure 4:
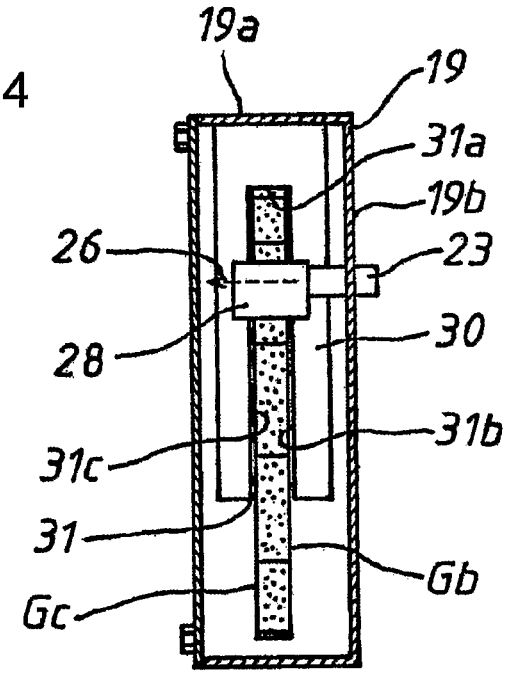
FIG. 4 is a front view showing an important part of the grinding machine.
Figure 5:
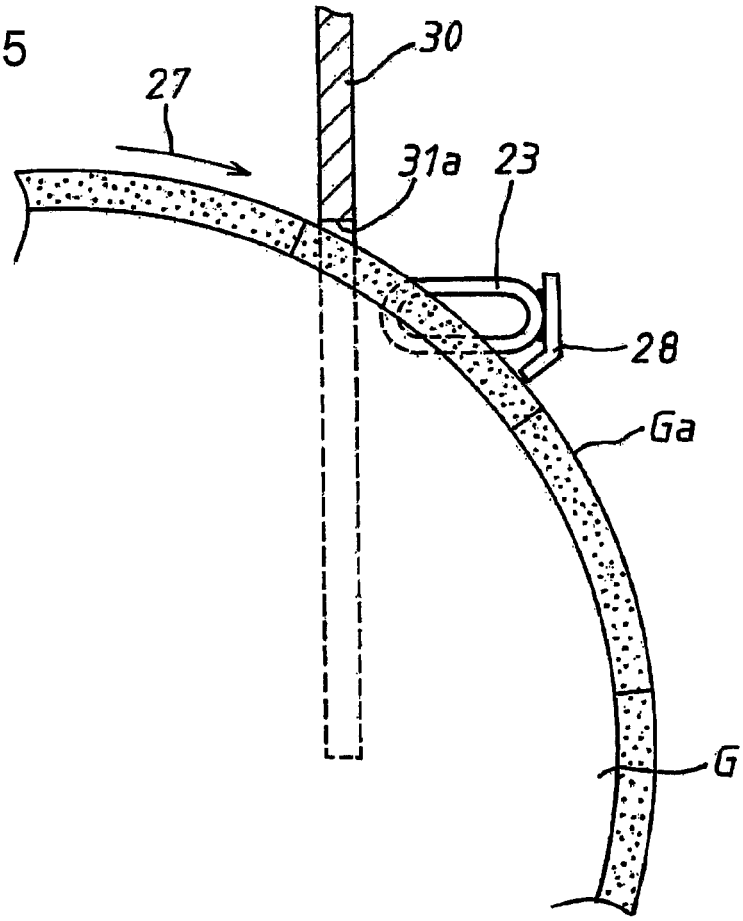
FIG. 5 is an enlarged fragmentary view showing an air jet nozzle portion with a baffle member.

As shown in FIG. 4, an air jet nozzle (fluid jet nozzle) 23 horizontally opens at one lateral side Gb of the grinding wheel G toward the front circumferential edge of the same. The air jet nozzle 23 is mounted on a lateral plate 19*b* of the wheel guard 19 at a position slightly behind or upstream in the grinding wheel rotational direction of the reaching point Gd where the coolant flow 22 reaches the grinding surface Ga of the grinding wheel G. The air jet nozzle 23 is connected to a pressurized air source 25 such as a factory air supply facility or the like through, e.g., a shutoff valve 24 of a solenoid-driven type. The air jet nozzle 23 blows an air jet so that the same traverses the circumferential grinding surface Ga from one lateral side Gb to the other lateral side Gc of the grinding wheel G to block or intercept a wheel-following air layer 27 which rotates to follow the grinding wheel G as shown in FIG. 5.

The opening area of the air jet nozzle 23 is formed to be elongated approximately in the radial direction of the grinding wheel G so that the air jet 26 can be blown to traverse the front circumferential edge of the grinding wheel G even when the diameter of the grinding wheel G is decreased by the repetition of dressing operations.

Although in the present embodiment, air is supplied from the pressurized air source 25 to the air jet nozzle 23, the fluid employed for blocking or intercepting the wheel-following air layer 27 which rotates to follow the grinding wheel G is not limited to air. In stead, the fluid may be mist which is made of air including a small quantity of coolant or any other gas than air.

A numeral 28 denotes a plate-like baffle member secured bodily to the air jet nozzle 23. In order to prevent the air jet 26 from interfering with the coolant flow 22, the baffle member 28 is arranged between paths of the coolant flow 22 and the air jet 26 to extend in parallel to the air jet 26 adjacently of the circumferential grinding surface Ga.

As best shown in FIG. 4, a wind breaker plate 30 is secured to be suspended from the top plate 19*a* of the wheel guard 19. An opening channel 31 is formed on the wind breaker plate 30. In order to intercept the wheel-following air layer 27 which rotates to follow the circumferential grinding surface Ga of the grinding wheel G, a channel bottom edge 31 a of the opening channel 31 extends at a position slightly upstream of the air jet 26 in the grinding wheel rotational direction to traverse and face the circumferential grinding surface Ga of the grinding wheel G with a minute clearance. Opposite side edges 31*b*, 31*c* of the wind breaker plate 30 defining the opening channel 31 face the lateral side surfaces Gb, Gc of the grinding wheel G with minute clearances therebetween and extend downward beyond the grinding point P. In order that the minute clearance between the channel bottom edge 31 a of the opening channel 31 and the circumferential grinding surface Ga of the grinding wheel G can be kept constant, the wind breaker plate 30 may be mounted on the wheel guard 19 through a position compensation mechanism which automatically compensates the position of the wind breaker plate 30 for decreases by dressings in the wheel diameter of the grinding wheel G.

As shown in FIG. 2, the servomotor 12 is connected to a digital servo control device 40*a*, which is connected to a CNC (Computer Numerical Control) device 41 for controlling the whole of the grinding machine. The rotation of the servomotor 12 is controlled based on a difference between a feed command from the CNC device 41 and a position feedback signal for the wheel head 11 from the encoder 12*a*, to control the feed rate and the feed position of the wheel head 11. The servomotor 15 is connected to another digital servo control device 40*b*, which is connected to the CNC device 41. The digital servo control device 40*b* controls the rotation of the servomotor 15 based on a difference between a feed command from the CNC device 41 and a position feedback signal for the table 14 from the encoder 15*a*, to control the feed rate and the feed position of the table 14.

In addition to the digital servo control devices 40*a*, 40*b*, the CNC device 41 is also connected to a sequence controller (hereafter referred to as "PLC") 42 for performing an open/close control of the solenoid shutoff valve 24 and the control of the coolant supply device 20, and an input/output device 43 for inputting and outputting various kinds of information.

The coolant supply device 20 is composed of the pump 34, the motor 35 and an inverter circuit 36 for controlling the rotation of the motor 35. The inverter circuit 36 is connected to the PLC 42 and controls the rotation of the motor 35 in response to a rotation start command, a rotation stop command and a rotational speed command which are given from the CNC device 41 through the PLC 42, whereby the coolant nozzle 21 is supplied with coolant of the flow quantity depending on the rotational speed of the pump 34.

The CNC device 41 is provided with a CPU 44, a ROM 45 and a RAM 46 for storing input data thereto. The ROM 45 stores a grinding program for controlling a grinding cycle having procedural steps shown in FIG. 6, in the form of an NC program.

Figure 7:
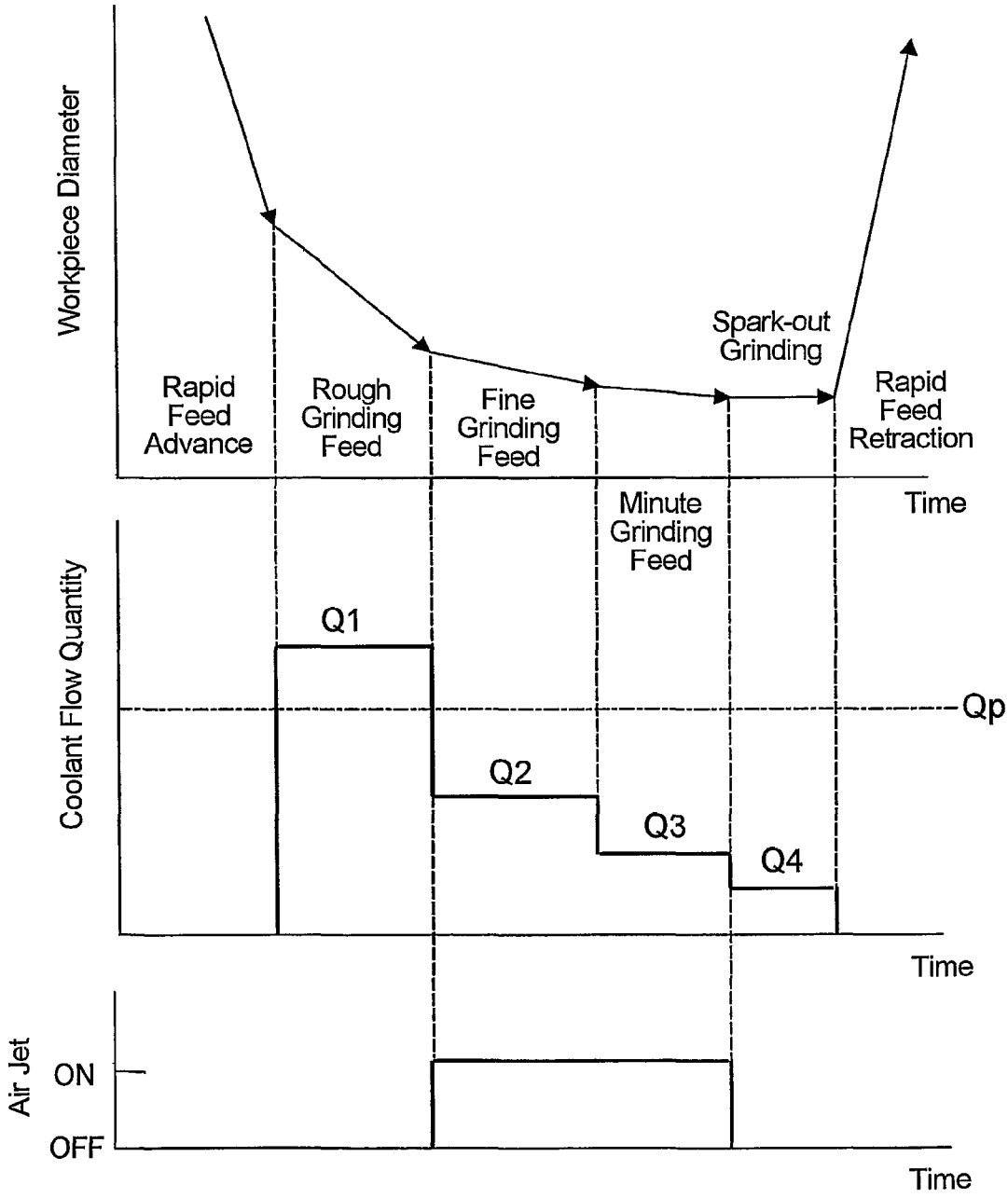
FIG. 7 is a time chart for explaining the relation between one grinding process, a flow quantity of coolant and an air jet.

Under the grinding cycle, the table 14 is successively positioned to make the circumferential grinding surface Ga of the grinding wheel G selectively face the first ground portion WI through the fourth ground portions W4 of the workpiece W shown in FIG. 3, and a grinding process is performed following each such positioning of the table 14. The grinding process performed for each of the first ground portion W1 through the fourth ground portions W4 is a plunge grinding process for grinding each such ground portion by infeeding the grinding wheel G toward the rotational axis of the workpiece W. As shown in FIG. 7, the plunge grinding process is organized so that the wheel head 11 is rapidly advanced at a rapid feed step, is then advanced with the feed rate switched stepwise at a rough grinding step, a fine grinding step and a minute grinding step, is stopped for a predetermined period of time at the infeed end of the minute grinding step for a spark-out grinding, and finally, is rapidly retracted at a rapid retraction step. The switching from the rough grinding step to the fining grinding step, the switching from the fine grinding step to the minute grinding step and the switching form the minute grinding step to a spark-out grinding step at the infeed end of the minute grinding step are carried out respectively when the wheel head 11 reaches respective switching positions therefor one after another. In the case that a dimension measuring device is provided, the switchings of these grinding steps may be carried out in dependence on respective diameters of the workpiece W detected by the dimension measuring device.

The grinding program includes rotational speed commands for the pump 34 which determine coolant flow quantities to be supplied during the respective grinding steps and open/close commands for the solenoid shutoff valve 24.

Next, description will be made regarding a method of determining flow quantities of coolant to be supplied at the respective grinding steps and the timing when the air jet 26 is to be supplied. Infeed amounts per abrasive grain of the grinding wheel G at the respective grinding steps are determined in dependence on the rotational speed of the workpiece W, the feed rate of the wheel head 11 and the circumferential speed of the grinding surface Ga of the grinding wheel G. In dependence on the infeed amounts per abrasive grain, the flow quantities of coolant which are to be supplied during the respective grinding steps are determined to be (Q1) through (Q4) as shown in FIG. 7. Further, the air jet 26 is determined to be supplied or not to be supplied in dependence on the flow quantity of coolant supplied during each grinding step. That is, the air jet 26 is determined not to be supplied for each grinding step during which the coolant is supplied beyond such a flow quantity that enables the coolant to pass through the wheel-following air layer 27 rotating to follow the circumferential grinding surface Ga of the grinding wheel G, but is determined to be supplied for each grinding step during which the coolant is supplied at such a flow quantity that does not enable the coolant to pass through the wheel-following air layer 27 rotating to follow the circumferential grinding surface Ga of the grinding wheel G. Accordingly, where a flow quantity that enables the coolant to pass through the wheel-following air layer 27 rotating to follow the circumferential grinding surface Ga of the grinding wheel G is taken as Qp, the air jet 26 is not supplied at the rough grinding step during which the coolant is supplied in the flow quantity Qp or more, whereas the air jet 26 is supplied at each of the fine grinding step and the minute grinding step during which the coolant is supplied in less than the flow quantity Qp. Further, at the spark-out grinding step serving as a final grinding step, the air jet 26 is not supplied so that the wheel-following air layer 27 is allowed to reach the grinding point P. Thus, the coolant flow 22 is deflected toward the workpiece W side, and the ratio of the coolant quantity to a part supplied to the grinding point P is decreased to increase the ratio of the coolant quantity to the remaining part showered over the workpiece W. As a result, a dynamic pressure which is caused by the coolant to be generated at the grinding point P is lowered, and even where the workpiece W has a cutout such as oil hole, groove or the like on the ground portion, it can be prevented that the cutout influences a large fluctuation of the dynamic pressure to bring about deterioration in roundness and generation of chatter marks.

As apparent from the foregoing, in the present embodiment, the rough grinding step corresponds to a heavy grinding, the fine grinding step and the minute grinding step correspond to a light grinding, and the spark-out grinding step corresponds to a final grinding step. The heavy grinding and the light grinding are distinguished from each other in terms of the quantity of coolant for cooling the heat generated by grinding, that is, in terms of the dimension of infeed amount. For example, if the infeed amount per abrasive grain is large at the fine grinding step shown in FIG. 7 and thus, the flow quantity Qp or more of coolant is needed for cooling the heat generated thereat, the fine grinding step would be regarded as the heavy grinding. Further, if the grinding process does not include the spark-out grinding, the minute grinding step would be regarded as the final grinding step.

(Operation)

Figure 6:
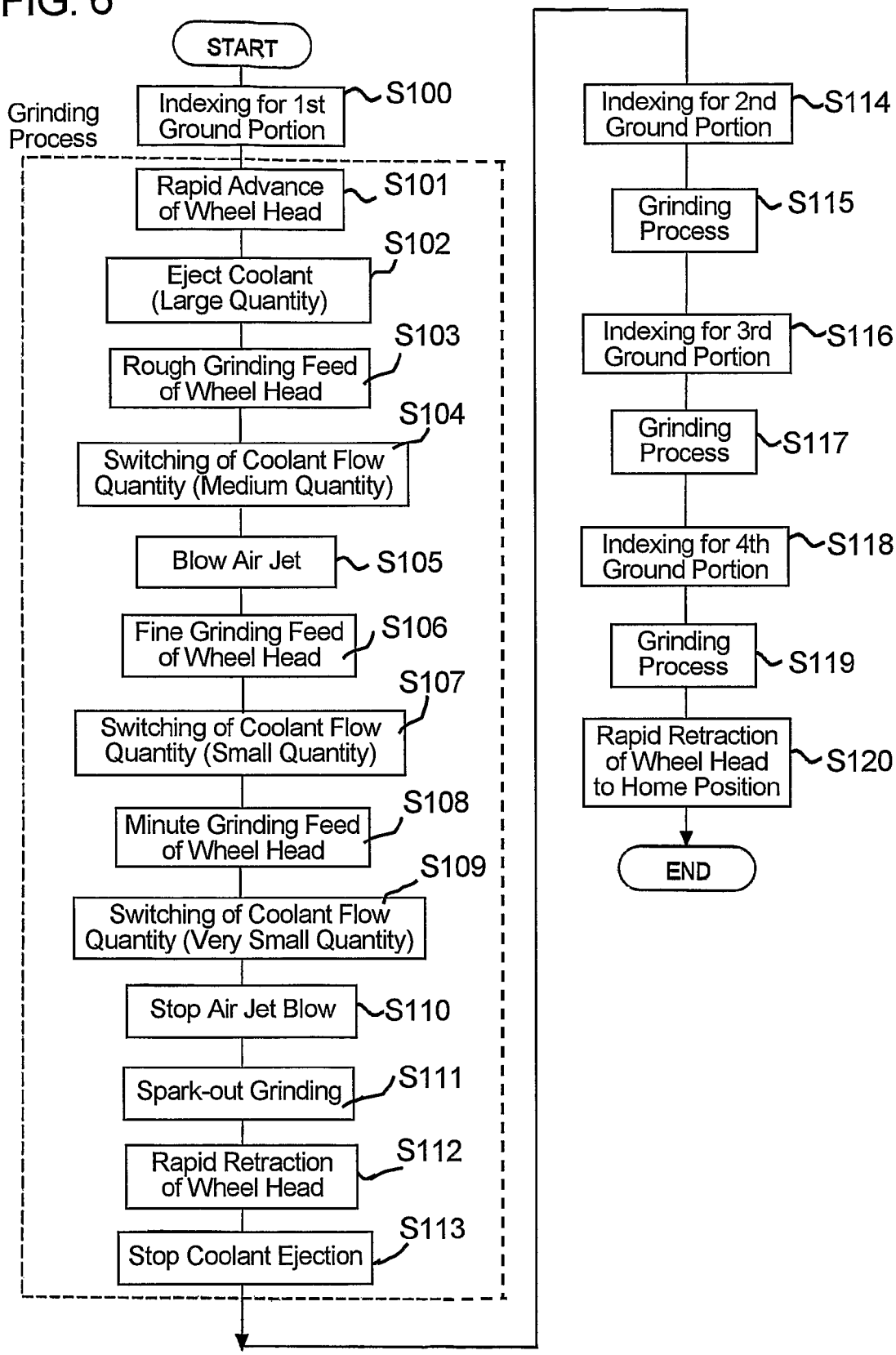
FIG. 6 is a flow chart showing a grinding cycle executed by the CNC device.

With the aforementioned construction, the operation of the CNC device 41 will be described in accordance with a grinding cycle shown in FIG. 6. First of all, the operator puts the workpiece W to be supported between the pair of centers of the work head (not shown) and the foot stock 18 and depresses a grinding execution start switch (not shown) on the input/output device 43. This causes the NC program to be executed to start the grinding cycle shown in FIG. 6. Upon starting of the grinding cycle, the ball screw mechanism 16 is rotationally driven by the servomotor 15 which is commanded from the CNC device 41, and the table 14 is moved and positioned to make the first ground portion W1 of the workpiece W face the grinding wheel G (Step S100). The ball screw mechanism (not shown) is rotationally driven by the servomotor 12, and the wheel head 11 is rapidly fed to a grinding start position slight behind a position where the grinding wheel G begins to contact with the workpiece W (Step S101).

Then, a rotation start command and a rotational speed for the pump 34 are output from the NC device 41 to the inverter circuit 36 of the coolant supply device 20 through the PLC 42. When given the rotation start command and the rotational speed for the pump 34, the inverter circuit 36 rotates the motor 35 at the commanded rotational speed, and the pump 34 supplies coolant of a large quantity such as the flow quantity (Q1) from the coolant reservoir 32 to the coolant nozzle 21, whereby the coolant flow 22 is ejected from the coolant nozzle 21 toward the reaching point Gd (Step S102).

At the rough grinding step, because the infeed amount of the grinding wheel G against the workpiece W per rotation of the same is large, coolant of the large flow quantity (Q1) is supplied toward the reaching potion Gd to prevent the first ground portion W1 from suffering grinding burn and heat stress. Then, a command for switching the feed rate of the wheel head 11 to a rough grinding feed rate is output to the digital servo control device 40*a*, whereby the first ground portion W1 of the workpiece W is roughly ground with the grinding wheel G (step S103). Where coolant of the large quantity (Q1) is supplied in this way, the coolant flow 22 passes through the wheel-following air layer 27 rotating to follow the grinding wheel G and reaches the grinding point P. Therefore, during the rough grinding step, the first ground portion W1 of the workpiece W is cooled with the coolant flow 22 of the large flow quantity (Q1) and is prevented from suffering grinding burn and heat stress.

When it is detected from the present position of the wheel head 11 that the workpiece W has been ground to a diameter for completion of the rough grinding step, a rotational speed for the pump 34 during the fine grinding step is output from the CNC device 41 through the PLC 42 to the inverter circuit 36 of the coolant supply device 20. When receiving the rotational speed command for the pump 34 during the fine grinding step, the inverter circuit 36 rotates the motor 35 at the commanded rotational speed, and the pump 34 supplies coolant of a medium flow quantity (Q2) from the coolant reservoir 32 to the coolant nozzle 21, whereby the coolant flow 22 is supplied from the coolant nozzle 21 toward the reaching point Gd on the grinding wheel G (step S104). In this state, the wheel-following air layer 27 has been formed around the grinding wheel G being rotated at a high speed to rotate therewith. Thus, the coolant supplied toward the reaching point Gd would be blocked or intercepted by the wheel-following air layer 27 and would be unable to reach the reaching point Gd.

To avoid this, the CNC device 41 outputs a command for opening the shutoff valve 24, through the PLC 42 at step S105. Upon opening of the shutoff valve 24, the air jet 26 is supplied from the pressurized air source 25 through the shutoff valve 24 in the open state to the air jet nozzle 23. The air jet 26 is blown to traverse the grinding surface Ga from one lateral side of the grinding wheel G toward the other lateral side at the position slightly upstream in the grinding wheel rotational direction of the reaching point Gd at which the coolant flow 22 is to reach the circumferential grinding surface Ga. The wheel-following air layer 27 which rotates to follow the circumferential grinding surface Ga of the grinding wheel G rotating at the high speed is intercepted by the jet flow of the air jet 26 to be prevented from reaching the reaching point Gd, whereby the coolant flow 22 supplied from the coolant nozzle 21 is adhered to the circumferential grinding surface Ga without being blocked by the wheel-following air layer 27 and is reliably delivered to the grinding point P. Since the air jet 26 traverses the circumferential grinding surface Ga at the position slightly upstream of the reaching point Gd in the grinding wheel rotational direction, the wheel-following air layer 27 is not generated on the circumferential grinding surface Ga between the air jet 26 and the reaching point Gd. Then, the CNC device 41 outputs a command for switching the feed rate of the wheel head 11 to a fine grinding feed rate, to the digital servo control device 40*a*, whereby the first ground portion W1 of the workpiece W is finely ground with the grinding wheel G (step S106).

When it is detected from the present position of the wheel head 11 that the grinding has been completed to a diameter for completion of the fine grinding step, a rotational speed for the pump 34 during the minute grinding step is output from the CNC device 41 through the PLC 42 to the inverter circuit 36 of the coolant supply device 20. When receiving the rotational speed command for the pump 34 during the minute grinding step, the inverter circuit 36 rotates the motor 35 at the commanded rotational speed, and the pump 34 supplies coolant of a small flow quantity (Q3) from the coolant reservoir 32 to the coolant nozzle 21, whereby the coolant flow 22 is supplied from the coolant nozzle 21 toward the reaching point Gd on the grinding wheel G (step S107). In this state, the air jet 26 continues to be supplied to the air jet nozzle 23, and the air jet 26 is blown to traverse the grinding surface Ga from one lateral side of the grinding wheel G toward the other lateral side at the position slightly upstream in the grinding wheel rotational direction of the reaching point Gd at which the coolant flow 22 is to reach the circumferential grinding surface Ga. The wheel-following air layer 27 which rotates together with the circumferential grinding surface Ga of the grinding wheel G rotating at the high speed is intercepted by the jet flow of the air jet 26 to be prevented from reaching the reaching point Gd, whereby the coolant flow 22 supplied from the coolant nozzle 21 is continued to be adhered to the circumferential grinding surface Ga without being blocked by the wheel-following air layer 27 and is reliably delivered to the grinding point P. Then, the CNC device 41 outputs a command for switching the feed rate of the wheel head 11 to a minute grinding feed rate, to the digital servo control device 40*a*, whereby the first ground portion W1 of the workpiece W is minutely ground with the grinding wheel G (step S108).

When it is detected from the present position of the wheel head 11 that the grinding has been completed to a diameter for completion of the minute grinding step, a rotational speed for the pump 34 during a spark-out grinding step is output from the CNC device 41 through the PLC 42 to the inverter circuit 36 of the coolant supply device 20. When receiving the rotational speed command for the pump 34 during the spark-out grinding step, the inverter circuit 36 rotates the motor 35 at the commanded rotational speed, and the pump 34 supplies coolant of an extremely small flow quantity (Q4) from the coolant reservoir 32 to the coolant nozzle 21, whereby the coolant flow 22 is supplied from the coolant nozzle 21 toward the reaching point Gd on the grinding wheel G (step S109). Then, a command for closing the shutoff valve 24 is output from the CNC device 41 through the PLC 42 at step S110. With the shutoff valve 24 closed, the air jet 26 from the pressurized air source 25 comes not to be supplied to the air nozzle 23. This causes the wheel-following air layer 27 to reach the grinding point P without being intercepted by the air jet 26. In this state, because the flow quantity (Q4) is extremely small, the coolant flow 22 is deflected by the wheel-following air layer 27 toward the side of the workpiece W. With the coolant flow 22 deflected by the wheel-following air layer 27 toward the side of the workpiece W, the coolant which is supplied to the grinding point P is decreased thereby to increase the ratio of the coolant quantity (Q4) to a part which is showered on the workpiece W. Then, the CNC device 41 outputs a command for stopping the feed of the wheel head, 11, to the digital servo control device 40*a*, whereby the first ground portion W1 of the workpiece W is put under the spark-out grinding with the grinding wheel G (step S111). At this time, a dynamic pressure which is generated by the coolant flow 22 at the grinding point P is lowered during the spark-out grinding. Therefore, even where the ground portion of the workpiece W has a cutout such as oil hole, groove or the like, it can be prevented that a large fluctuation of the dynamic pressure by the influence of the cutout causes the roundness to be deteriorated and chatter marks to be generated. At the same time, the flow quantity of the coolant showered on the workpiece W is increased, so that the workpiece W can be cooled sufficiently to be enhanced in dimensional accuracy.

After the spark-out grinding for a predetermined time period, the CNC device 41 at step S112 rapidly retracts the wheel head 11 and stops the pump 34 at step S113 thereby to complete the grinding process on the first ground portion W1.

Upon completion of the grinding process on the first ground portion W1, the ball screw mechanism 16 is rotationally driven by the servomotor 15, and the table 14 is moved to make a second ground portion W2 of the workpiece W face the grinding wheel G (step S114). Then, at step S115, the grinding process shown as those from step S101 through step S113 are carried out, so that the grinding process on the second ground portion W2 is completed.

Further, at step S116, the positioning of the table 14 is performed to make a third ground portion W3 of the workpiece W face the grinding wheel G. Then, at step S117, the grinding process shown as those from step S101 through step S113 are carried out, so that the grinding process on the third ground portion W3 is completed.

Thereafter, at step S118, the positioning of the table 14 is performed to make a fourth ground portion W4 of the workpiece W face the grinding wheel G and then, at step S119, the grinding process shown as those from step S101 through step S113 are carried out. When the grinding process on the fourth ground portion W4 is completed, the wheel head 11 is retracted to a home position (retracted position) at step S120 to terminate the grinding cycle of the workpiece W.

As understood from the foregoing, a heavy grinding control means in the present invention corresponds to the operations that the CNC device 41 executes at the steps S102 and S103 in the foregoing grinding cycle, and a light grinding control means corresponds to the operations that the CNC device 41 executes at steps S104 through S108 in the foregoing grinding cycle. Further, a final feed step control means corresponds to the operations that the CNC device 41 executes at the steps S110 and S111 in the foregoing grinding cycle.

As described above, at the rough grinding step wherein the infeed amount is large, the grinding point P has much heat generation to rise to a high temperature, and the large quantity (Q1) of coolant is supplied to cool such heat. Because of being supplied in the large quantity (Q1), coolant is able to pass through the wheel-following air layer 27 and to reach the grinding point P without using the air jet 26 to intercept the wheel-following air layer 27 rotating to follow the grinding wheel G. For this reason, the supply of the air jet 26 is not needed at the rough grinding step. Thus, it can be avoided that the coolant flow 22 is scattered by the air jet 26 to be suspended in the air in the form of mist during the supply of coolant in the large quantity (Q1). Further, at the fine grinding step and the minute grinding step each with a small infeed amount, the heat generated at the grinding point P is small, and the cooling of the grinding point P can be done with coolant in the small quantity (Q2 or Q3) so far as such coolant is supplied reliably to the grinding point P. For this reason, at each of the fine grinding step and the minute grinding step, the coolant is supplied in the small quantity (Q2 or Q3), and the air jet 26 is supplied to intercept the wheel-following air layer 27 rotating to follow the grinding wheel G, so that coolant of the small quantity (Q2 or Q3) can reliably reach the grinding point P. Accordingly, it can be realized to decrease the quantity of coolant used at the fine grinding step and the minute grinding step.

Where in this way, the supply or non-supply of the air jet 26 is controlled in dependence on the infeed amount (i.e., the flow quantity of coolant), it can be realized to reduce the quantity of coolant scattered in the form of mist to a small quantity and to prevent the environment in a factory or the like having the grinding machine installed therein from being deteriorated. Further, since only a small quantity of coolant is scattered, it does not occur that coolant enters the inside of the grinding machine which ordinarily does not allow coolant to enter, and the maintenance of the grinding machine can be simplified. In addition, since the air jet 26 is supplied only when required, the quantity of the air jet 26 used can be reduced thereby to lower the running cost for the grinding machine.

Furthermore, the supply of the air jet 26 is stopped during the spark-out grinding because the infeed amount is very small which is given by a minute spring-back motion of the workpiece W and because the workpiece W can be cooled without making coolant to reach the grinding point P. Thus, during the spark-out grinding, the wheel-following air layer 27 is allowed to reach the grinding point P, and the coolant flow 22 is deflected toward the workpiece W side thereby to decrease the ratio of the coolant (Q4) to a part supplied to the grinding point P and to increase the ratio of the coolant (Q4) to another part showered on the workpiece W. Consequently, the dynamic pressure which is generated by the coolant at the grinding point G is lowered, and hence, even where the ground portion of the workpiece W has a cutout such as oil hole, groove or the like, it can be prevented that a large fluctuation of the dynamic pressure by the influence of the cutout causes the roundness to be degraded and chatter marks to be generated. At the same time, the flow quantity of the coolant showered on the workpiece W is increased, so that the workpiece W can be cooled sufficiently to be enhanced in dimensional accuracy.

In the foregoing embodiment, the flow quantity of coolant is altered at the same time as the switching of the grinding step. However, due to a substantial spring-back motion of the workpiece W in the case of the large infeed amount, the infeed amount of the grinding wheel G continues to be large momentarily even after the feed rate of the grinding wheel G is lowered by being switched from the rough grinding feed rate to the fine grinding feed rate. Therefore, the flow quantity of coolant may not be decreased for such moment and then, may be decreased at a time point when the infeed amount is decreased as the feed rate is lowered.

Further, the flow quantity of coolant supplied to the coolant nozzle 21 may be controlled by rotating the pump 34 at a constant speed and by controlling the opening degree of a variable flow volume control valve of a solenoid-operated type which may be provided on an intermediate portion of the supply conduit 33.

Further, although in the foregoing embodiment, the invention is employed as one example in a plunge grinding wherein the grinding wheel G is infed against a ground surface of a ground portion on the workpiece W, it may instead be employed in a traverse grinding wherein a ground portion of a workpiece is ground by moving the grinding wheel G along the ground surface in parallel thereto after infeeding the grinding wheel G against one or opposite ends of the ground portion.

Various features and many of the attendant advantages in the foregoing embodiments will be summarized as follows:

In the coolant supply method in the foregoing embodiment typically shown in FIGS. 1, 4 and 7, during the heavy grinding having the large infeed amount per abrasive grain, the grinding point P has a large quantity of heat generated thereat to rise to a high temperature, and the large quantity (Q1) of coolant is supplied to cool the grinding point P. Since by being supplied in the large quantity (Q1), the coolant is enabled to pass through the wheel-following air layer 27 and to reach the grinding point P without being intercepted by the wheel-following air layer 27 which rotates to follow the grinding wheel G, by the use of the air jet 26. Thus, the supply of the air jet 26 is stopped during the heavy grinding. Thus, the large quantity (Q1) of the coolant can be prevented from being scattered by the air jet 26 to be suspended in the form of mist during the heavy grinding. Further, during the light grinding having the small infeed amount per abrasive grain, the heat generated at the grinding point P is small, and the grinding point P can be cooled with the small quantity (Q2 or Q3) of the coolant so far as the same is reliably supplied to the grinding point P. Thus, during the light grinding, it is realized to make the coolant of the small quantity (Q2 or Q3) reach the grinding point P reliably by supplying the air jet 26 to intercept the wheel-following air layer 27 which rotates to follow the grinding wheel G, while supplying the coolant of the small quantity (Q2 or Q3). As a consequence, it can be realized to reduce the quantity of the coolant used during the light grinding.

Also in the coolant supply method in the foregoing embodiment typically shown in FIGS. 1, 4 and 7, at a final grinding step of the light grinding such as the spark-out grinding step or the minute grinding step on certain occasions, the infeed amount is very small, and the grinding point P can be cooled without having the coolant reached thereto. For this reason, the supply of the air jet 26 is stopped at the final grinding step. Thus, the wheel-following air layer 27 is allowed to reach the grinding point P to deflect the coolant flow 22 toward the side of the workpiece W. This results in decreasing the ratio of the coolant quantity (Q4) to a part supplied to the grinding point P and increasing the ratio of the coolant quantity (Q4) to another part showered on the workpiece W. Consequently, the dynamic pressure generated by the coolant at the grinding point P is lowered, and even in the case of a workpiece with a cutout such as oil hole, groove or the like, it can be prevented that a large fluctuation in the dynamic pressure by the influence of the cutout causes the roundness to be deteriorated and chatter marks to be generated. At the same time, the coolant quantity showered on the workpiece W is increased to cool the workpiece W sufficiently, so that the dimensional accuracy of the workpiece W can be enhanced.

In the grinding machine in the foregoing embodiment typically shown in FIGS. 1, 4 and 7, the supply flow quantity of the coolant and the supply or non-supply of the air jet 26 are controlled in dependence on the infeed amount at each of the grinding steps, and the quantity of the coolant which is scattered in the form of mist can be reduced to a small quantity, so that the environment in the factory with the grinding machine installed can be prevented from being deteriorated. Further, since the coolant is scattered in a small quantity only, it does not take place that the coolant enters the inside of the grinding machine which ordinarily dose not allow the coolant to enter, so that the grinding machine can be simplified in maintenance. In addition, since the air jet 26 is supplied only when required, the quantity of the air jet 26 used can be reduced, and the grinding machine can be low in the running cost.

Also in the grinding machine in the foregoing embodiment typically shown in FIGS. 1, 4 and 7, the supply of the air jet 26 is stopped at the final grinding step, and hence, the dynamic pressure generated at the grinding point P is lowered. Thus, even in the case of a workpiece with a cutout such as oil hole, groove or the like, it can be prevented that a large fluctuation in the dynamic pressure by the influence of the cutout causes the roundness to be deteriorated and chatter marks to be generated. At the same time, the coolant quantity showered on the workpiece W is increased to cool the workpiece W sufficiently, so that the dimensional accuracy of the workpiece W can be enhanced to make the grinding machine highly precise.

Obviously, numerous modifications and variations of the present invention are possible in light of the above teachings. It is therefore to be understood that within the scope of the appended claims, the present invention may be practiced otherwise than as specifically described herein.

INDUSTRIAL APPLICABILITY

As described above, the coolant supply method and the grinding machine capable of practicing the method according to the present invention are useful as those employed in the field of the grinding technology and preferably, in a high-speed and high-grinding area of the grinding technology field. In terms of cost reduction and high performance, heavy duty grinding using a large quantity of coolant and high precision machining have to be convertible in high speed grinding of mass-production workpieces such as automotive parts typically including crankshaft, cam shaft or the like. Also, the requirement for improvement in job environment increasingly becomes important for healthcare of workers at the grinding machine facilities. The coolant supply method and the grinding machine according to the present invention are originated for the purpose of satisfying these requirements which have been long-felt but unsolved in the grinding machine field.

The invention claimed is:

1. A method of supplying coolant in a grinding machine wherein a grinding wheel carried on a wheel head and rotationally driven is given a grinding feed relative to a workpiece supported on a workpiece support device for grinding the workpiece with a grinding surface of the grinding wheel with coolant being supplied to a grinding point, the method comprising the steps of:

providing at a position upstream of the grinding point in a grinding wheel rotational direction a fluid jet nozzle which blows a fluid jet to traverse the grinding surface of the grinding wheel from one lateral side of the grinding wheel to the other lateral side for intercepting a wheel-following air layer rotating to follow the grinding wheel;

supplying a large quantity of the coolant while stopping the supply of the fluid jet during a heavy grinding having a large infeed per abrasive grain of the grinding wheel; and supplying a small quantity of the coolant while supplying the fluid jet during a light grinding having a small infeed per abrasive grain of the grinding wheel.

2. The method of supplying coolant as set forth in claim 1, further comprising the step of discontinuing the supply of the fluid jet at a final grinding step of the grinding feed.

3. A grinding machine wherein a grinding wheel carried on a wheel head and rotationally driven is given a grinding feed relative to a workpiece supported on a workpiece support device for grinding the workpiece with a grinding surface of the grinding wheel with coolant being supplied to a grinding point, the grinding machine comprising:

a fluid jet nozzle provided at a position upstream of the grinding point in a grinding wheel rotational direction for blowing a fluid jet to traverse the grinding surface of the grinding wheel from one lateral side of the grinding wheel to the other lateral side so that a wheel-following air layer rotating to follow the grinding wheel is intercepted;

heavy grinding control means for supplying a large quantity of the coolant while stopping the supply of the fluid jet during a heavy grinding having a large infeed per abrasive grain of the grinding wheel; and light grinding control means for supplying a small quantity of the coolant while supplying the fluid jet during a light grinding having a small infeed per abrasive grain of the grinding wheel.

4. The grinding machine as set forth in claim 3, further comprising final grinding step control means for discontinuing the supply of the fluid jet at a final grinding step of the grinding feed.

* * * * *